US007784382B2

(12) United States Patent
Alford

(10) Patent No.: US 7,784,382 B2
(45) Date of Patent: Aug. 31, 2010

(54) ADJUSTABLE WRENCH

(76) Inventor: Larry Alford, 41 Anglesey Dr., Kardinya (AU) WA 6163

( * ) Notice: Subject to any disclaimer, the term of this patent is extended or adjusted under 35 U.S.C. 154(b) by 0 days.

(21) Appl. No.: 12/368,556

(22) Filed: Feb. 10, 2009

(65) Prior Publication Data

US 2009/0320650 A1 Dec. 31, 2009

(51) Int. Cl.
*B25B 13/12* (2006.01)
*B25B 13/22* (2006.01)

(52) U.S. Cl. ..... 81/109; 81/126; 81/142

(58) Field of Classification Search ..... 81/109, 81/126–129.5, 136, 137, 142, 143
See application file for complete search history.

(56) References Cited

U.S. PATENT DOCUMENTS

| | | | | | |
|---|---|---|---|---|---|
| 746,504 | A * | 12/1903 | Hardy et al. | ..... | 81/143 |
| 1,006,057 | A * | 10/1911 | Brown | ..... | 81/143 |
| 1,169,750 | A * | 1/1916 | Walsh | ..... | 81/143 |
| 1,689,072 | A * | 10/1928 | Grimsrud | ..... | 81/328 |
| 2,784,629 | A * | 3/1957 | Adair | ..... | 81/409 |
| 3,232,150 | A * | 2/1966 | Ailegraud | ..... | 81/143 |
| 3,376,766 | A * | 4/1968 | Vienat | ..... | 81/138 |
| 4,995,297 | A * | 2/1991 | Richards | ..... | 81/126 |
| 5,568,752 | A | 10/1996 | Alford | | |
| 6,145,415 | A * | 11/2000 | Liu | ..... | 81/143 |
| 6,568,300 | B1 * | 5/2003 | Steffe | ..... | 81/126 |

* cited by examiner

*Primary Examiner*—David B Thomas
(74) *Attorney, Agent, or Firm*—RatnerPrestia

(57) ABSTRACT

An adjustable wrench includes a body with a first jaw fixed to the body, and a second jaw movable relative to the first jaw. A lever mechanism is coupled to the body and the second jaw to effect motion of the second jaw relative to the first jaw. The wrench also includes a locking mechanism having a free state in which the first and second jaws move relative to each other, and a locking state in which the first and second jaws are locked from movement away from each other. The locking mechanism changes from the free state to the locking state after an object is gripped between the first and second jaws. The locking mechanism includes a pawl coupled with the lever mechanism, the pawl being arranged to move linearly into engagement with the body when the locking mechanism changes from the free state to the locking state.

20 Claims, 5 Drawing Sheets

ADJUSTABLE WRENCH

CROSS REFERENCE TO RELATED APPLICATION

This application claims priority of German Utility Patent No. DE 20 2008 007 934, filed Jun. 13, 2008.

FIELD OF THE INVENTION

The present invention relates to an adjustable wrench.

BACKGROUND OF THE INVENTION

Adjustable spanners and wrenches are particularly useful as they can accommodate nuts and bolts of various size. One common type of adjustable spanner comprises a fixed jaw and a moveable jaw which is journalled to a worm gear that can be rotated by the thumb of a user. Rotation of the worm gear causes the moveable jaw to move relative to the fixed jaw to facilitate gripping of a nut or bolt. One difficulty with this type of adjustable spanner is that adjusting the spanner to engage a nut or bolt can be time consuming particularly in a confined environment and/or where the nut or bolt cannot be easily seen. A further difficulty is that the worm gear is designed to provide a degree of play between the jaws. This may at times result in the spanner slipping when torque is applied. Additionally, in areas where the spanner cannot be rotated a full 360°, applying torque to a nut or bolt requires repeated engagement and disengagement of the spanner with the nut/bolt.

The present inventor has developed numerous alternative adjustable spanners including that described in U.S. Pat. No. 5,568,752. The spanner described in the above referenced U.S. patent comprises a handle provided with a fixed jaw, and a lever pivotally coupled to the handle and to a second jaw. A link is pivotally connected at one end to the second jaw and pivotally connected at an opposite end to the lever. The link carries a cam that rides in an elongate slot cut in a head of the handle, the slot being provided along one surface with a rack of teeth. The cam and slot cooperate to form a locking mechanism which has a first state in which the cam is disengaged from the teeth and wherein the jaws are able to move relative to each other, and a locking state in which the cam is rotated via the link into engagement with the teeth to lock the jaws against movement away from each other.

SUMMARY OF THE INVENTION

In one embodiment, the present invention provides an adjustable spanner comprising:

a body provided with a first jaw at one end;

a second jaw moveable relative to the first jaw;

a lever mechanism coupled to the body and the second jaw to effect motion of the second jaw relative to the first jaw; and, a locking mechanism having a free state in which the first and second jaws are able to move relative to each other, and a locking state in which the first and second jaws are locked from movement away from each other, the locking mechanism changing from the free state to the locking state after an object is gripped between the first and second jaws, the locking mechanism comprising a pawl coupled with the lever mechanism, wherein the pawl is arranged to move linearly into engagement with the body when the locking mechanism changes state from the free state to the locking state, the engagement of the pawl with the body preventing motion of the first and second jaws away from each other.

The locking mechanism may comprise a link pivotally coupled with the lever mechanism, and wherein the pawl is coupled to the link in a manner wherein pivotally motion of the link is translated into linear motion of the pawl.

In one embodiment the pawl is coupled to the link by a pivot pin and one of the link and the pawl is provided with a linear slot along which the pivot pin slides.

The link may be further configured to wedge the pawl against the body when the locking mechanism is in the locking state.

In one embodiment the link comprises a wedging member which wedges between the body and the pawl when the locking mechanism is in the locking state.

The link may comprise a plate having opposite faces wherein the wedging member protrudes from each of the opposite faces.

In one embodiment, the wedging member comprises a pin.

The body may comprise a slot in which the locking mechanism rides, the slot in the body having opposed first and second bearing surfaces, wherein the first bearing surface is provided with a rack of teeth which the pawl engages when the locking mechanism is in the locking state and wherein the wedging member contacts the second bearing surface when the locking mechanism is in the locking state.

The second jaw may comprise a linear channel in which the pawl resides, wherein the pawl slides along the linear channel when the state of the locking mechanism is changed.

The second jaw may comprise a recess that leads to the linear channel wherein the link is rotatably retained in the recess. In one embodiment, the lever is pivotally coupled to the locking mechanism and a first spring is provided which is coupled between the lever and the locking mechanism, the first spring biasing the locking mechanism toward the free state.

The lever mechanism may be coupled to the body, locking mechanism and second jaw in the manner wherein moving the lever toward the body causes the second jaw to move toward the first jaw until the object is gripped between the first and second jaws, wherein further movement of the lever mechanism toward the body causes the locking mechanism to pivot relative to the lever against the bias of the first spring and change the state of the locking mechanism to the locking state wherein the pawl slides into the engagement with the rack of teeth.

The lever mechanism may be arranged to move with a compound motion comprising both linear translation and pivotal motion relative to the body.

In one embodiment, the lever mechanism comprises the first, second, third and fourth arms wherein one end of each of the second and third arms is pivotally connected at spaced apart locations near one end of the first arm, an opposite end of the second arm is pivotally connected to the body, an opposite end of the third arm is pivotally connected to one end of the fourth arm, and an opposite end of the fourth arm is pivotally connected to the locking mechanism.

The adjustable wrench may further comprise a second spring which biases the second jaw away from the first jaw and wherein the lever mechanism applies force to the second jaw against the bias of the second spring when moving the second jaw toward the first jaw.

BRIEF DESCRIPTION OF THE DRAWINGS

Embodiments of the present invention will now be described in detail with reference to the accompanying drawings in which.

DETAILED DESCRIPTION OF PREFERRED EMBODIMENTS

Figure 6:
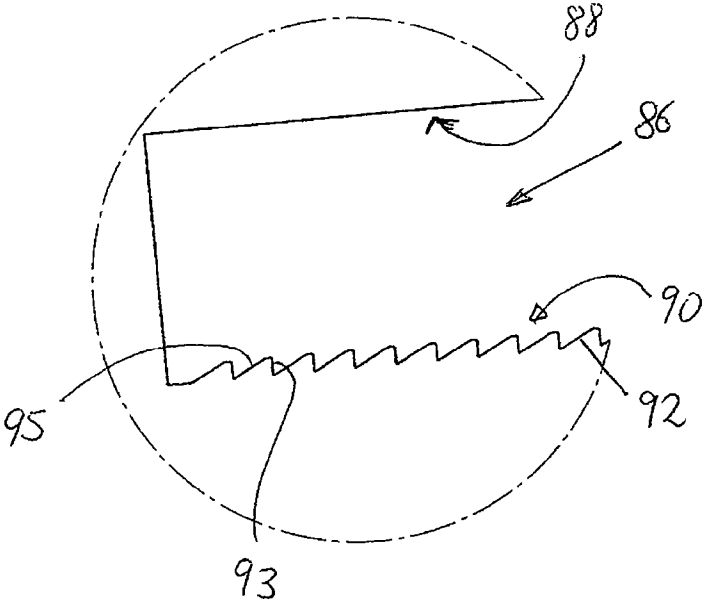
FIG. 6 is an enlarged view of a portion of a rack of teeth incorporated in the adjustable wrench.
Figure 1:
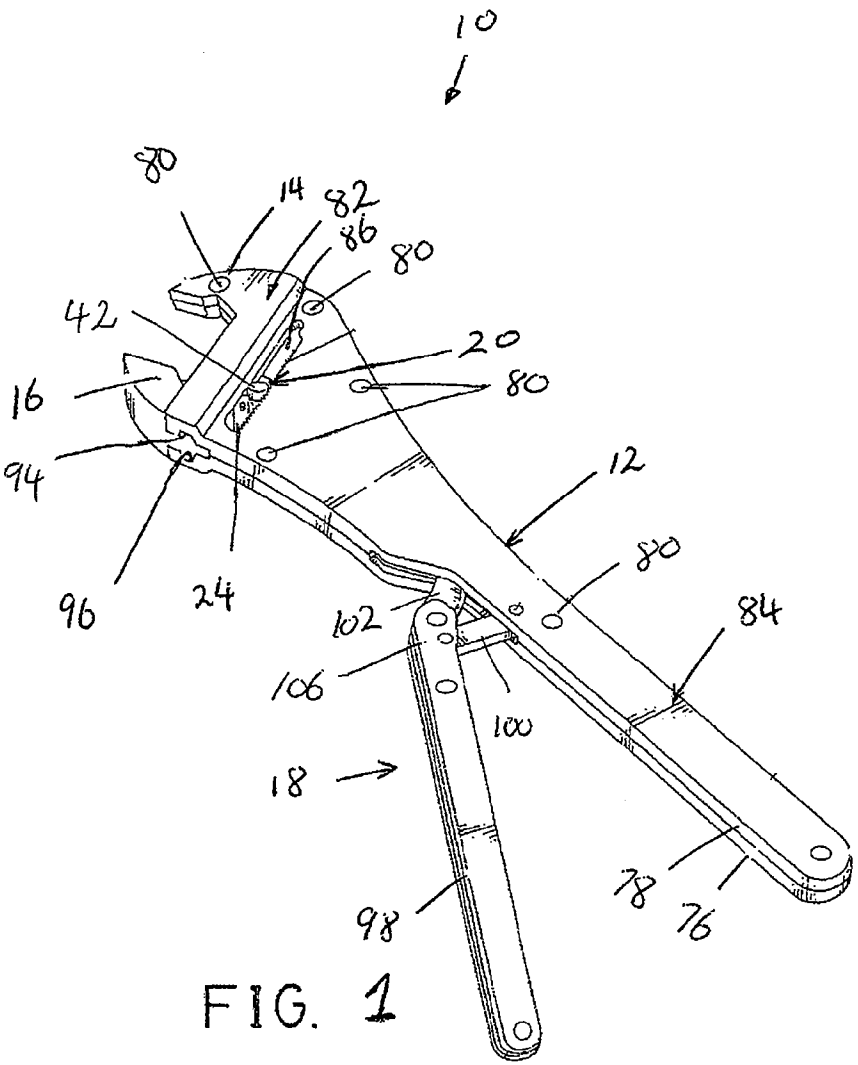
FIG. 1 is a perspective view of the adjustable wrench in a fully opened position.

With reference to the accompanying drawings, an embodiment of the adjustable wrench 10 comprises a body 12 provided with a first jaw 14, which is fixed to the body 12, and a second jaw 16 that is movable relative to the first jaw 14. A lever mechanism 18 is coupled to the body 12 and the second jaw 16 to effect motion of the second jaw relative to the first jaw 14. The wrench 10 also comprises a locking mechanism 20 having a free state in which the first and second jaws 14 and 16 are able to move relative to each other, and a locking state in which the first and second jaws are locked from movement away from each other. As explained in greater detail below, the locking mechanism 20 changes from the free state to the locking state after an object such as a nut 22 is gripped between the first and second jaws 14, 16. The locking mechanism 20 comprises a pawl 24 coupled with the lever mechanism 18, the pawl 24 being arranged to move linearly into engagement with the body 12 when the locking mechanism changes from the free state to the locking state. When the pawl 24 is engaged with the body 12, the first and second jaws 14 and 16 are prevented from motion away from each other.

Figure 2:
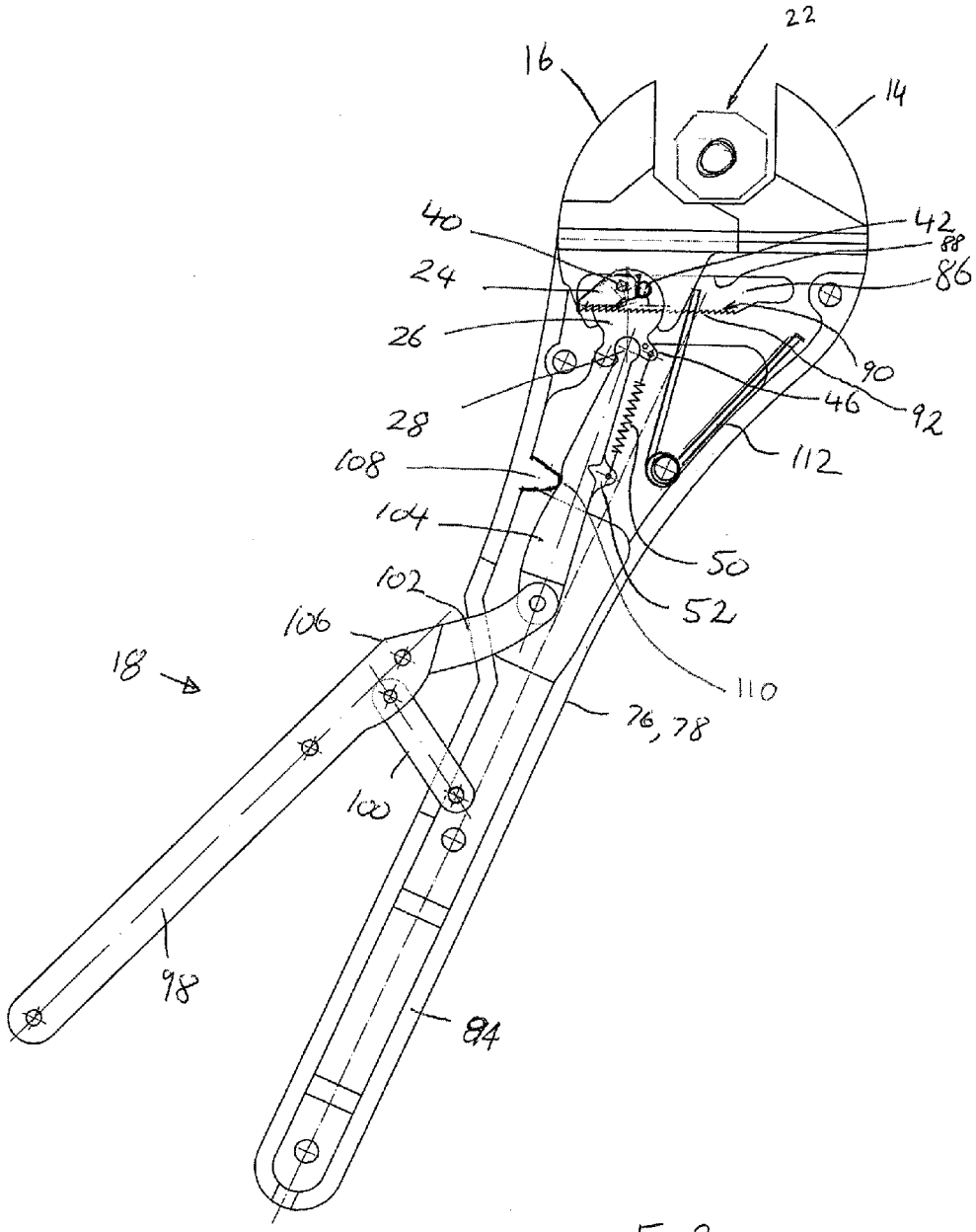
FIG. 2 is an internal view of the adjustable wrench in a fully opened position.
Figure 3A:
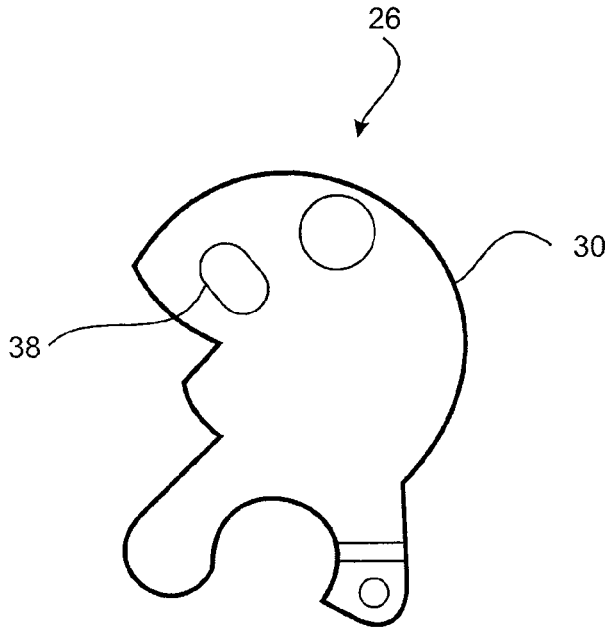
FIG. 3*a* is a plan view of a link incorporated in the adjustable wrench.
Figure 3B:
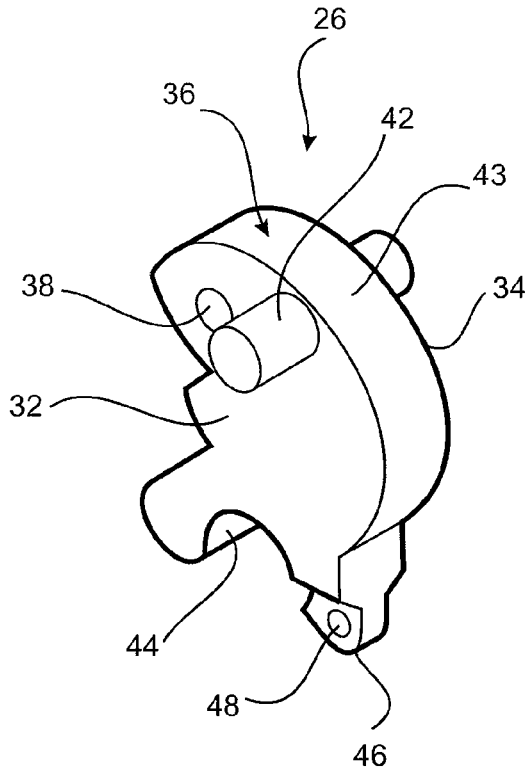
FIG. 3*b* is a perspective view of the link shown in FIG. 3*a;*

The locking mechanism 20 also comprises a link 26 (see FIGS. 2, 3*a* and 3*b*) to which the pawl 24 is coupled. The link 26 is pivotally coupled at one end 28 of the lever mechanism 18. The coupling of the pawl 24 to the link 26 is in the manner wherein pivotal motion of the link 26 is translated into linear motion of the pawl 24. The link 26 comprises a plate 30 having opposite faces 32 and 34 and a peripheral bearing surface 36 between the faces 32 and 34. A slot 38 is formed in the link 26 and opens onto the opposite faces 32 and 34. The pawl 24 is pivotally coupled to the link 26 by a pivot pin 40 which passes through the pawl 34 and the slot 38.

The link 26 comprises a wedging member in the form of a cylindrical pin 42 that extends through the plate 30 protruding from each of the opposite faces 32 and 34. The bearing surface 36 comprises a convexly curved portion 43 that is received by the second jaw 16, and a concavely curved portion 44 which receives the end 28 of the lever mechanism 18. A lug 46 depends from a location between the surface portions 43 and 44 and is provided with a hole 48 to facilitate connection to a first spring 50. The first spring 50 is coupled at an opposite end to a lug 52 formed on the lever mechanism 18.

Figure 4A:
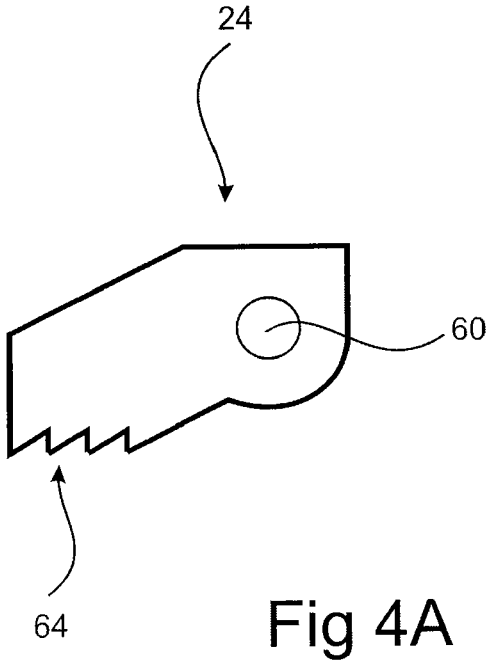
FIG. 4*a* is a side view of a pawl incorporated in the adjustable wrench.
Figure 4B:
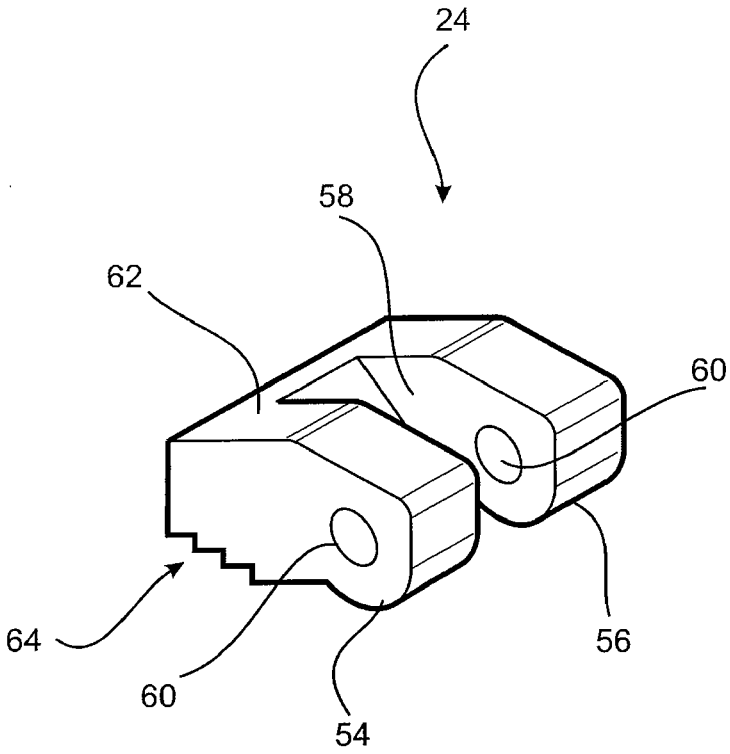
FIG. 4*b* is a perspective view of the pawl shown in FIG. 4*a;*

The pawl 24 (see FIGS. 4*a* and 4*b*) is of a general U shaped configuration having parallel legs 54 and 56 which are spaced apart to form a gap 58. Respective holes 60 are formed in alignment in each of the legs 54 and 56. The pawl 24 is also formed of a cross member 62 that joins the legs 54 and 56 together and is provided with a plurality of longitudinally extending teeth 64. The locking mechanism 20 is assembled by passing a portion of the plate 30 into the gap 58 with the holes 60 aligned with the slot 38 and subsequently passing the pin 40 through the holes 60 and the slot 38.

Figure 5A:
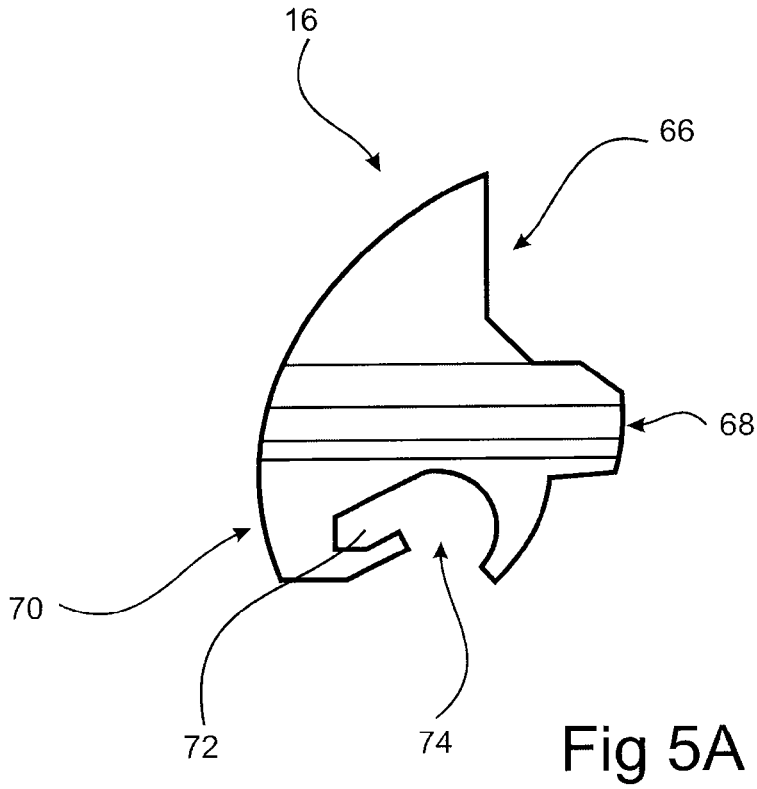
FIG. 5*a* is a plan view of a moveable jaw incorporated in the adjustable wrench.
Figure 5B:
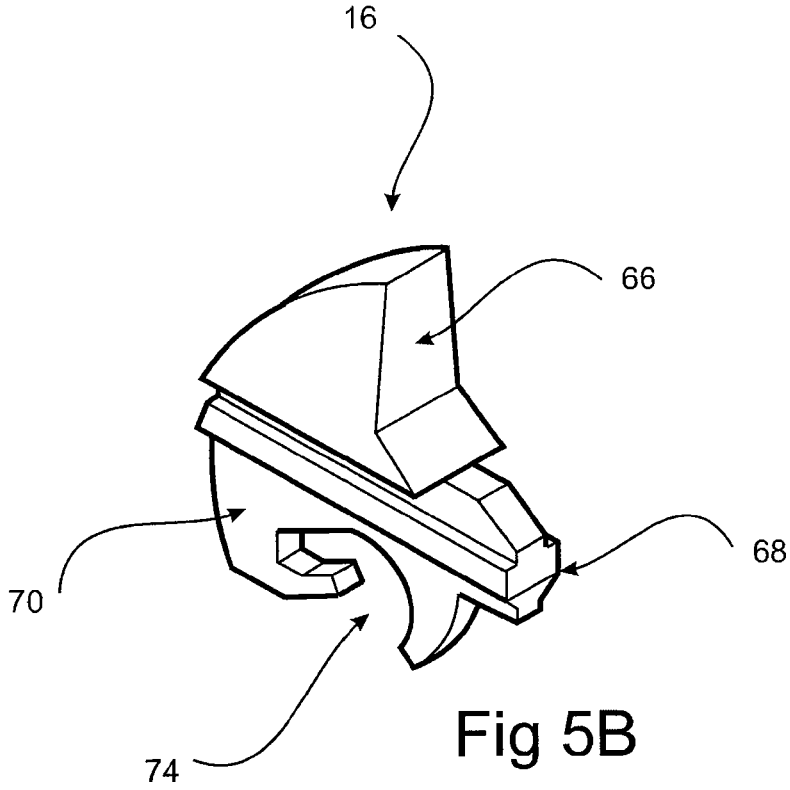
FIG. 5*b* is a perspective view of the jaw shown in FIG. 5*a;*.

With particular reference to FIGS. 5*a* and 5*b,* the second jaw 16 is formed of a bearing face 66 which in use bears against the nut 22 to be gripped by the wrench 10, a carriage portion 68 that is slidably received within a corresponding recess formed in the body 12, and a lobe 70. The lobe 70 is formed with a linear channel 72 in which the pawl 24 resides. The linear channel 72 confines the pawl 24 to slide linearly into and out of engagement with the body 12 when the locking mechanism 20 is moved between the free and locking states. The lobe 70 is further formed with a recess 74 which leads to the linear channel 72 and is configured to receive the convex surface portion 43 of the link 26. The recess 74 circumscribes an arc greater than 180° so that when the link 26 is seated in the recess 74, the link 26 is unable to linearly separate from the jaw 16.

The body 12 is composed of two complimentary halves 76 and 78 which are coupled together by a plurality of mechanical fasteners such as rivets 80. The body 12 is formed with a head 82 and a handle 84 extending from the head 82. A slot 86 is formed in the head 82 and is formed with opposing bearing surfaces 88 and 90. The bearing surface 90 is formed with a rack of teeth 92 that are configured to be complimentary to the teeth 64 on the pawl 24. Each tooth in the rack 92 is of the same shape and profile having a substantially upright front face 93 and an inclined back face 95. The locking mechanism 20 rides within the slot 86. More particularly, the pawl 24 and the wedging member 42 extend into the slot 86. The slot 86 extends through the thickness of the body 12 and may be considered as two separate slot halves each formed in respective body halves 76 and 78. An inside surface of each of the body halves 76 and 78 is also formed with mutually aligned linear channels 94 and 96 which receive the carriage 68. The channels 94 and 96 are parallel to the slot 86. When the lever mechanism 80 is pulled toward the handle 84, the carriage portion 68 slides along the channels 94 and 96 bringing the second jaw 16 closer to the first jaw 14.

The lever mechanism 18 comprises arms 98, 100, 102, and 104. The arm 98 is outside of the body 12 and forms a second handle for gripping by a user. One end of each of arms 100 and 102 is pivotally coupled near an end 106 of the arm 98. The pivot connection of the arm 102 to the arm 98 is closer to the end 106 than the pivot connection of the arm 100 to the arm 98. An opposite end of the arm 100 is pivotally connected inside the body 12 in the region of the handle 84. An opposite end of arm 102 is pivotally connected to a lower end of the arm 104. An opposite end of the arm 104 constitutes the end 28 of the lever mechanism 18 and, as previously mentioned, is coupled with the locking mechanism 20. The lug 52 to which the spring 50 is connected is formed as part of the arm 104. A fulcrum 108 is formed internally of the body 12 and bears against a recessed region 110 of the arm 104. Due to the arrangement of the lever mechanism 18, the lever mechanism 18 is able to move with a compound motion comprising both linear translation and pivotally motion. This also provides in effect a lengthening of the distance between distal ends of the arms 98 and 104 as the distance between the jaws 14 and 16 is reduced from a maximum spacing to a minimum spacing where the jaws 16 and 14 abut each other.

A second spring 112 is also seated inside the body 12 and bears against the jaw 16 biasing the jaw 16 away from the jaw 14. When the lever mechanism 18 is operated by squeezing the handle 84 and arm 98 together the arm 104 pivots in a clockwise direction about the fulcrum 108 moving the second jaw 16 toward the first jaw 14 against the bias of the spring 112. The spring 50 biases the locking mechanism 20 toward the free state and in particular acts to bias the link 26 to pivot in a clockwise direction about the end 28 of the lever mechanism 18.

Assuming that the nut 22 is placed between the jaws 16 and 14, continued squeezing of the handle 84 and lever 98 together will eventually result in the nut 22 being gripped by the jaws 16 and 14. Thereafter, continued pressure or squeezing on the handle 84 and arm 98 results in the link 26 being rotated in an anticlockwise direction about the end 28 and against the bias of the spring 50. This motion results in the wedging member/pin 42 being rotated into contact with the bearing surface 88 and the pawl 24 sliding linearly along the linear channel 72 into contact with the rack of teeth 92. Further, the pin 40 is also in contact with the pawl 24 and thus in effect wedges the pawl 94 onto the rack of teeth 92. The linear motion of the pawl 24 is substantially parallel to the angle of inclination of the back face 93 of the teeth in the rack of teeth 92.

The jaws 14 and 16 are locked from movement away from each other while the locking mechanism 20 is in the locking state. To release the locking mechanism 20 returning it to the free state, pressure is released from the lever mechanism 18 which results in the spring 50 rotating the link 96 in the clockwise direction thereby sliding the pawl 94 away from engagement with the rack of teeth 92. The spring 112 subsequently pushes the jaw 16 to slide away from the jaw 14.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. An adjustable wrench comprising:

a body provided with a first jaw at one end;

a second jaw moveable relative to the first jaw;

a lever mechanism coupled to the body and the second jaw to effect motion of the second jaw relative to the first jaw; and, a locking mechanism having a free state in which the first and second jaws are able to move relative to each other, and a locking state in which the first and second jaws are locked from movement away from each other, the locking mechanism changing from the free state to the locking state after an object is gripped between the first and second jaws, the locking mechanism comprising a pawl coupled with the lever mechanism, wherein the pawl is arranged to move linearly into engagement with the body when the locking mechanism changes state from the free state to the locking state, the engagement of the pawl with the body preventing motion of the first and second jaws away from each other, the locking mechanism comprising a link pivotally coupled with the lever mechanism, and wherein the pawl is coupled to the link by a pivot pin, one of the link and the pawl being provided with a linear slot along which the pivot pin slides in a manner wherein pivotal motion of the link is translated into linear motion of the pawl.

2. The adjustable wrench according to claim 1 wherein the link is configured to wedge the pawl against the body when the locking mechanism is in the locking state.

3. The adjustable wrench according to claim 2 wherein the link comprises a wedging member which wedges between the body and the pawl when the locking mechanism is in the locking state.

4. The adjustable wrench according to claim 3 wherein the link comprises a plate having opposite faces wherein the wedging member protrudes from each of the opposite faces.

5. The adjustable wrench according to claim 4 wherein the wedging member comprises a pin.

6. The adjustable wrench according to claim 1 wherein the lever is pivotally coupled to the locking mechanism and a first spring is provided which is coupled between the lever mechanism and the locking mechanism, the first spring biasing the locking mechanism towards the free state.

7. The adjustable wrench according to claim 6 wherein the lever mechanism is coupled to the body, the locking mechanism and the second jaw in the manner wherein moving the lever toward the body causes the second jaw to move toward the first jaw until the object is gripped between the first and second jaws, wherein further movement of the lever mechanism toward the body causes the locking mechanism to pivot relative to the lever against the bias of the first spring and change the state of the locking mechanism to the locking state wherein the pawl slides into the engagement with body.

8. The adjustable wrench according to claim 1 wherein the lever mechanism is arranged to move with a compound motion comprising both linear translation and pivotal motion relative to the body.

9. The adjustable wrench according to claim 1 comprising a second spring which biases the second jaw away from the first jaw and wherein the lever mechanism applies force to the second jaw against the bias of the second spring when moving the second jaw toward the first jaw.

10. An adjustable wrench comprising:

a body provided with a first jaw at one end;

a second jaw moveable relative to the first jaw;

a lever mechanism coupled to the body and the second jaw to effect motion of the second jaw relative to the first jaw; and, a locking mechanism having a free state in which the first and second jaws are able to move relative to each other, and a locking state in which the first and second jaws are locked from movement away from each other, the locking mechanism changing from the free state to the locking state after an object is gripped between the first and second jaws, the locking mechanism comprising a pawl coupled with the lever mechanism, wherein the pawl is arranged to move linearly into engagement with the body when the locking mechanism changes state from the free state to the locking state, the engagement of the pawl with the body preventing motion of the first and second jaws away from each other;

the body comprising a slot in which the locking mechanism rides, the slot in the body having opposed first and second bearing surfaces, wherein the first bearing surface is provided with a rack of teeth which the pawl engages when the locking mechanism is in the locking state and wherein the wedging member contacts the second bearing surface when the locking mechanism is in the locking state;

the teeth in the rack of teeth have a back face inclined at a first angle and wherein the linear motion of the pawl is along a path at an angle substantially the same as the first angle; and the second jaw comprising a linear channel in which the pawl resides, wherein the pawl slides along the linear channel when the state of the locking mechanism is changed.

11. The adjustable wrench according to claim 10 wherein the second jaw comprises a recess that leads to the linear channel wherein the link is rotatably retained in the recess.

12. The adjustable wrench according to claim 10 wherein the lever mechanism comprises first, second, third and fourth arms wherein one end of each of the second and third arms is pivotally connected at spaced apart locations near one end of the first arm, an opposite end of the second arm is pivotally connected to the body, an opposite end of the third arm is pivotally connected to one end of the fourth arm, and an opposite end of the fourth arm is pivotally connected to the locking mechanism.

13. An adjustable wrench comprising:

a body provided with a first jaw at one end;

a second jaw moveable relative to the first jaw, the second jaw having a linear channel;

a lever mechanism coupled to the body and the second jaw to effect motion of the second jaw relative to the first jaw;

a locking mechanism having a free state in which the first and second jaws are able to move relative to each other, and a locking state in which the first and second jaws are locked from movement away from each other, the locking mechanism changing from the free state to the locking state after an object is gripped between the first and second jaws, the locking mechanism comprising a pawl coupled with the lever mechanism and residing in the linear channel, wherein the pawl is arranged to slide along the linear channel into engagement with the body when the locking mechanism changes state from the free state to the locking state, the engagement of the pawl with the body preventing motion of the first and second jaws away from each other.

14. The adjustable wrench according to claim 13 wherein the locking mechanism comprises a link pivotally coupled with the lever mechanism, and wherein the pawl is coupled to the link in a manner wherein pivotal motion of the link is translated into linear motion of the pawl.

15. The adjustable wrench according to claim 14 wherein the pawl is coupled to the link by a pivot pin, and wherein one of the link and the pawl is provided with a linear slot along which the pivot pin slides.

16. The adjustable wrench according to claim 15 wherein the link is configured to wedge the pawl against the body when the locking mechanism is in the locking state.

17. The adjustable wrench according to claim 13 wherein the body comprises a slot in which the locking mechanism rides, the slot in the body having opposed first and second bearing surfaces, wherein the first bearing surface is provided with a rack of teeth which the pawl engages when the locking mechanism is in the locking state and wherein the wedging member contacts the second bearing surface when the locking mechanism is in the locking state.

18. The adjustable wrench according to claim 17 wherein the teeth in the rack of teeth have a back face inclined at a first angle and wherein the linear motion of the pawl is along a path at an angle substantially the same as the first angle.

19. The adjustable wrench according to claim 13 wherein the lever is pivotally coupled to the locking mechanism and a first spring is provided which is coupled between the lever mechanism and the locking mechanism, the first spring biasing the locking mechanism toward the free state.

20. The adjustable wrench according to claim 19 wherein the lever mechanism is coupled to the body, the locking mechanism and the second jaw in the manner wherein moving the lever toward the body causes the second jaw to move toward the first jaw until the object is gripped between the first and second jaws, wherein further movement of the lever mechanism toward the body causes the locking mechanism to pivot relative to the lever against the bias of the first spring and change the state of the locking mechanism to the locking state wherein the pawl slides into the engagement with body.

* * * * *